US005618091A

United States Patent [19]

Huber et al.

[11] Patent Number: 5,618,091

[45] Date of Patent: Apr. 8, 1997

[54] DRAWER ASSEMBLY

[75] Inventors: Edgar Huber, Hard; Helmut Hollenstein, Lustenau; Reinhard Mäser, Bregenz, all of Austria

[73] Assignee: Julius Blum Gesellschaft m.b.H., Höchst, Austria

[21] Appl. No.: 396,772

[22] Filed: Mar. 1, 1995

[30] Foreign Application Priority Data

Oct. 5, 1994 [AT] Austria ..... 333/94 U

[51] Int. Cl.[6] ..... A47B 88/00

[52] U.S. Cl. ..... 312/348.1; 312/348.4; 312/265.5; 403/12

[58] Field of Search ..... 312/334.19, 330.1, 312/334.21, 348.1, 348.2, 348.4, 263, 265.5, 265.6; 403/12, 384, 230

[56] References Cited

U.S. PATENT DOCUMENTS

| | | | |
|---|---|---|---|
| Re. 26,666 | 9/1969 | Marateck et al. | 312/334.19 |
| 1,172,189 | 2/1916 | Bauer | 312/348.4 |
| 3,416,850 | 12/1968 | Hilfinger et al. | 312/348.4 X |
| 3,511,550 | 5/1970 | Hilfinger et al. | 312/348.4 X |
| 4,128,284 | 12/1978 | King | 312/348.2 |
| 4,379,604 | 4/1983 | Rock et al. | 312/348.1 |
| 4,802,716 | 2/1989 | Rock et al. | 312/330.1 |
| 5,172,971 | 12/1992 | Albizz | 312/330.1 X |
| 5,449,231 | 9/1995 | Lin | 312/330.1 X |

FOREIGN PATENT DOCUMENTS

| | | | |
|---|---|---|---|
| 3038832 | 5/1982 | Germany | 312/334.19 |
| 3643068 | 6/1988 | Germany | 312/348.3 |
| 2087715 | 6/1982 | United Kingdom . | |
| 2101879 | 1/1983 | United Kingdom . | |

*Primary Examiner*—Peter M. Cuomo
*Assistant Examiner*—Janet M. Wilkens
*Attorney, Agent, or Firm*—Wenderoth, Lind & Ponack

[57] ABSTRACT

A drawer assembly includes two metallic drawer side walls having rear ends provided with devices for fastening to a drawer rear wall and further being provided with respective support flanges for a bottom plate. The drawer side walls have at front ends thereof flanges that project inwardly and that have rearwardly projecting lugs stamped out of such flanges. The lugs project into holes in a fastening plate positioned at and abutting rear sides of the flanges and to be connected to a front plate that abuts front sides of the flanges.

40 Claims, 10 Drawing Sheets

DRAWER ASSEMBLY

BACKGROUND OF THE INVENTION

The invention relates to a drawer assembly including two metallic drawer side walls, each such drawer side wall having at a rear end thereof a device for connection to a drawer rear wall and further each being provided with a support flange for a bottom plate.

With most drawers according to the prior art, a front plate and the rear wall have to be fastened to the side walls by means of screws or dowels, which is very time consuming. In most cases the rear wall and the front plate are made of wood. Other drawers have knockdown connections between the front plate, the rear wall and the drawer side walls which enables assembling of the drawer parts without tools. Such constructions allow rapid assembly of drawers. The parts of such drawers are made of plastic material. Such drawers are described in GB-A-20 87 715 and GB-A-21 01 879. Drawers made of plastic material, however, cannot carry heavy loads.

SUMMARY OF THE INVENTION

It is an object of the invention to provide a drawer assembly with metal drawer side walls which enables a very rapid connection of the metal drawer side walls to a front plate and a rear wall made of wood. The connection should be very rigid and should be achievable to a great extent without the use of tools, so that such a drawer easily can be assembled by a customer.

In a drawer assembly in accordance with the invention, each of a pair of metal drawer side walls has a front end provided with a flange projecting laterally inwardly, such flange having a rearwardly projecting lug that is stamped from the flange. These lugs project into holes in a fastening plate that is positioned at and abuts rear sides of the flanges and that is connected to a front plate that abuts front sides of said flanges.

DESCRIPTION OF PREFERRED EMBODIMENTS

Figure 1:
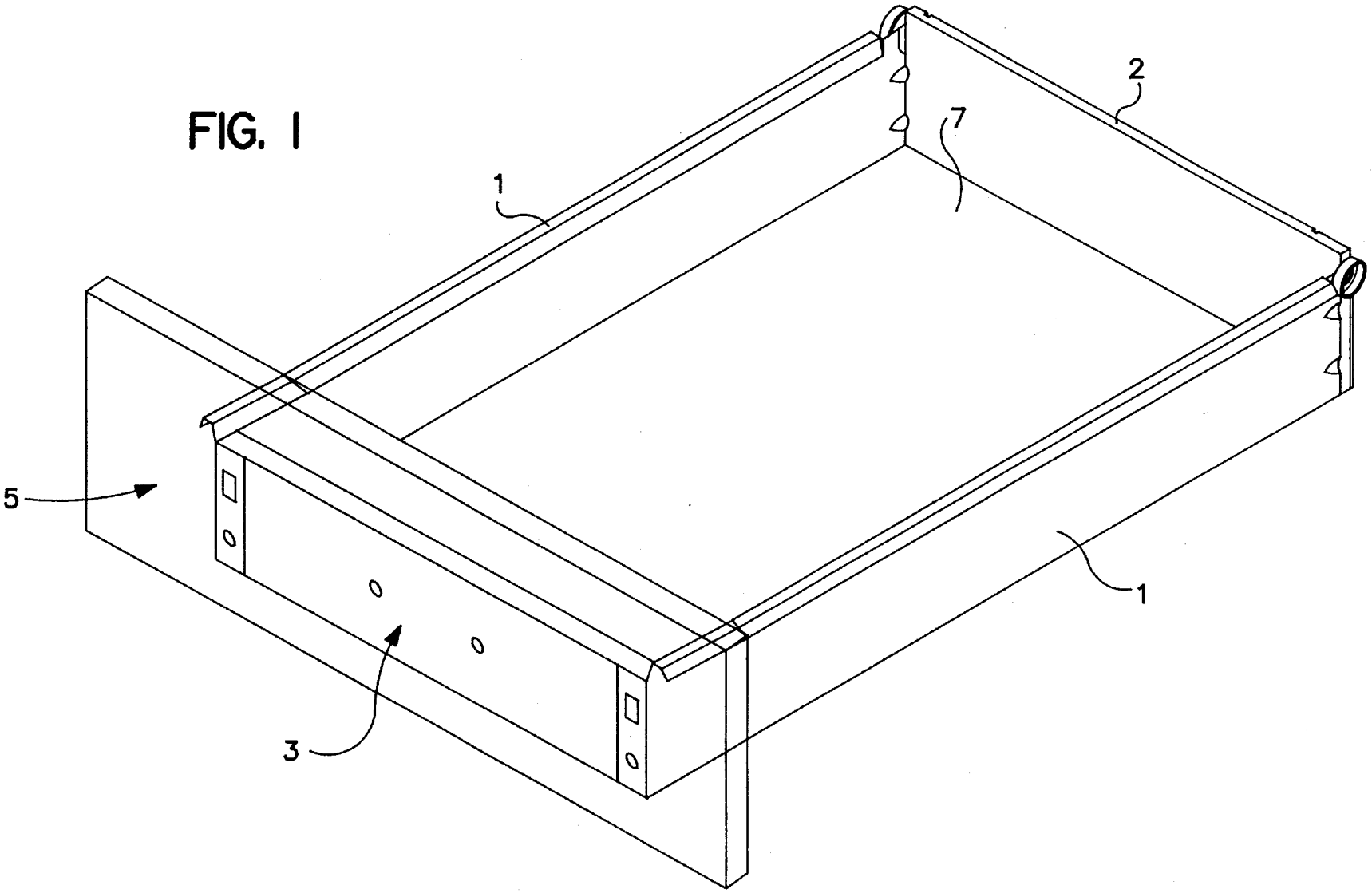
FIG. 1 is a perspective view of a drawer according to the invention.
Figure 2:
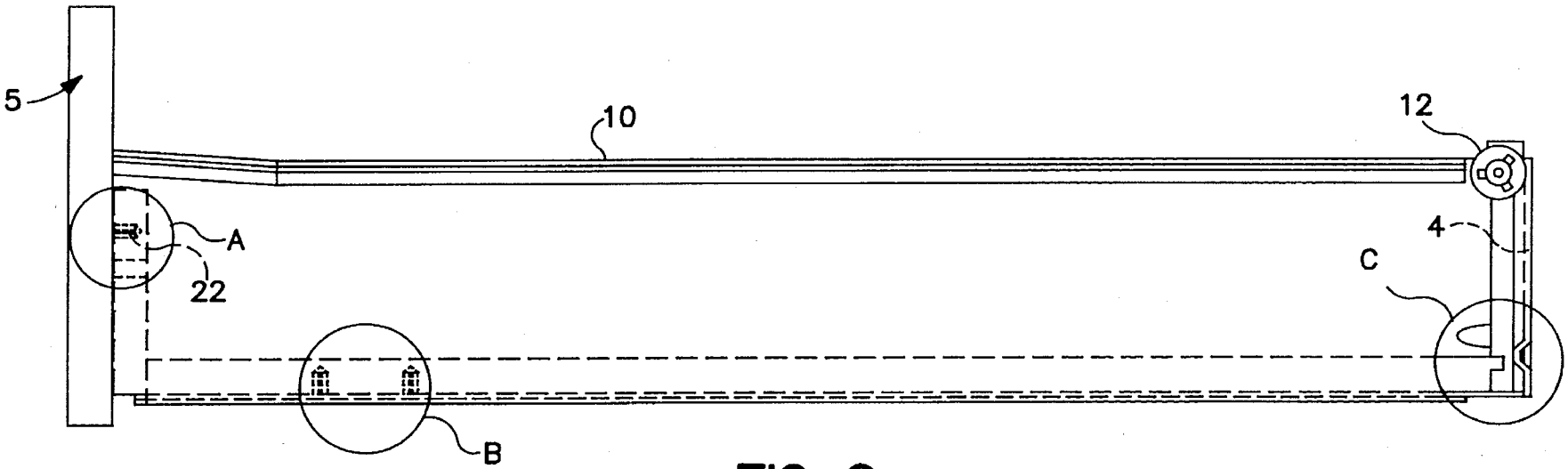
FIG. 2 is a side view of the drawer.
Figure 4:
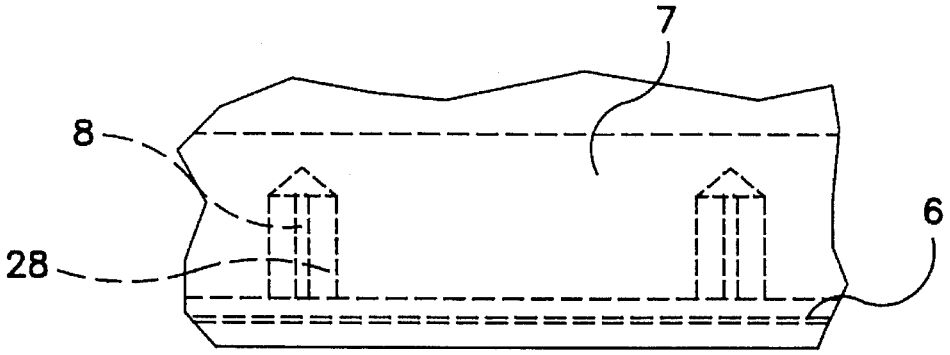
FIG. 4 is an enlarged view of detail B of FIG. 2.
Figure 5:
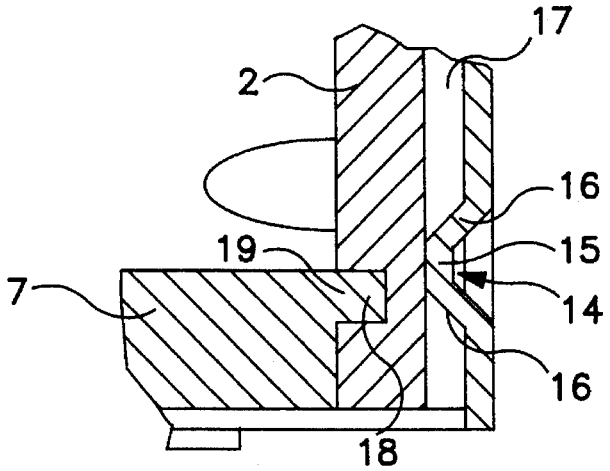
FIG. 5 is an enlarged view of detail C of FIG. 2.
Figure 6:
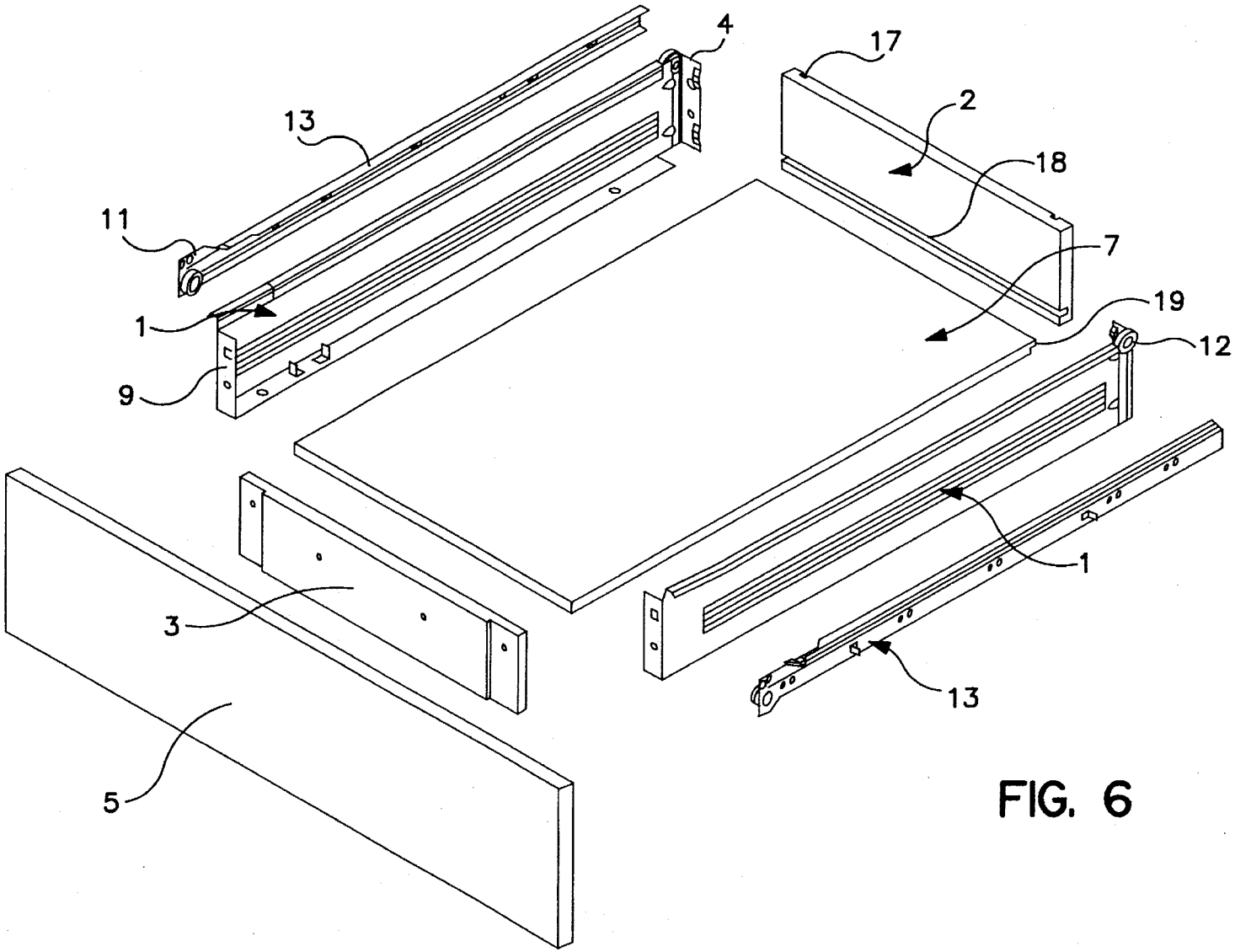
FIG. 6 is an exploded perspective view of the drawer.
Figure 7:
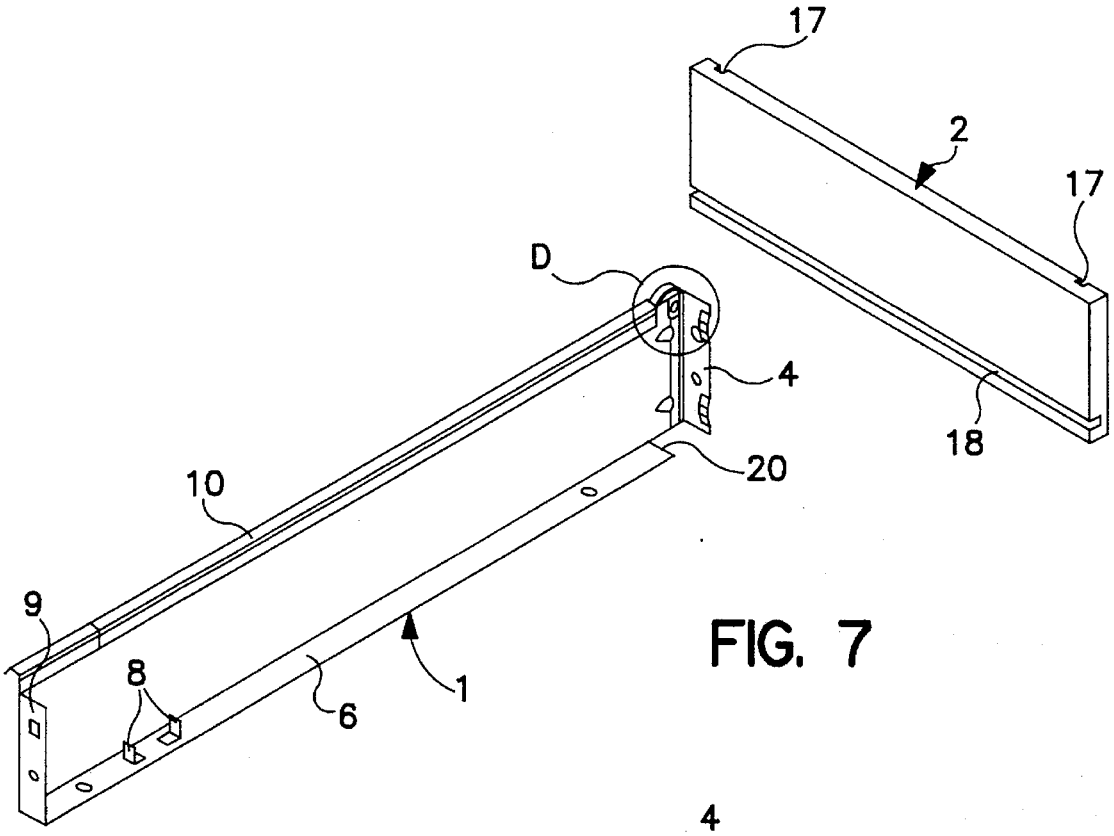
FIG. 7 is a perspective view showing connecting of a rear wall with a side wall.
Figure 8:
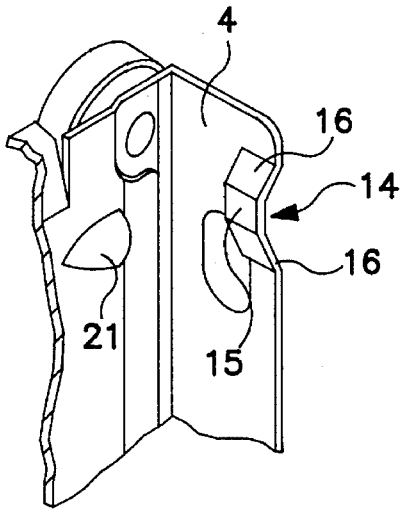
FIG. 8 is an enlarged view of detail D of FIG. 7.
Figures 9, 10:
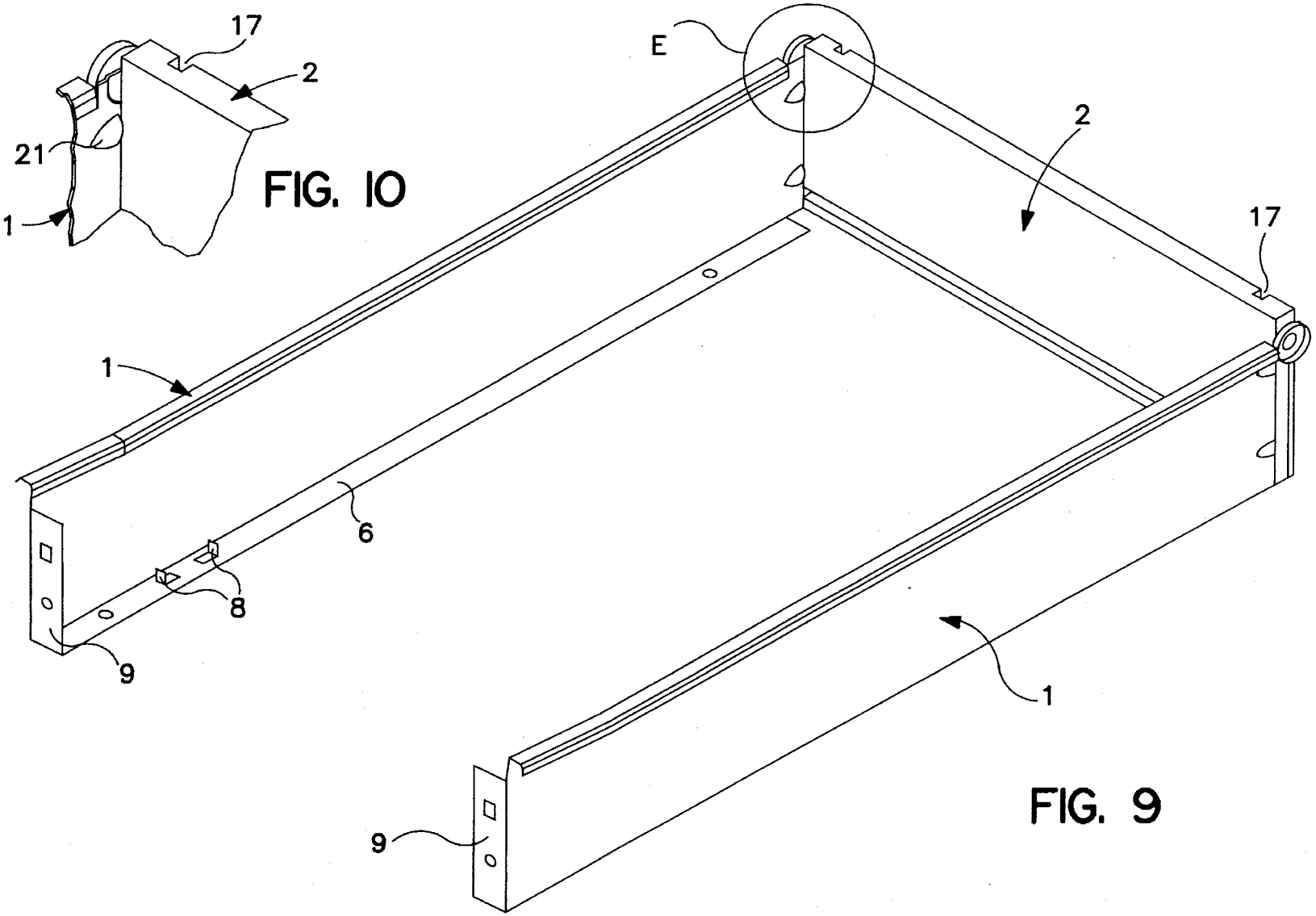
FIG. 9 is a perspective view of the drawer side walls and the rear wall.
FIG. 10 is an enlarged view of detail E of FIG. 9.
Figure 11:
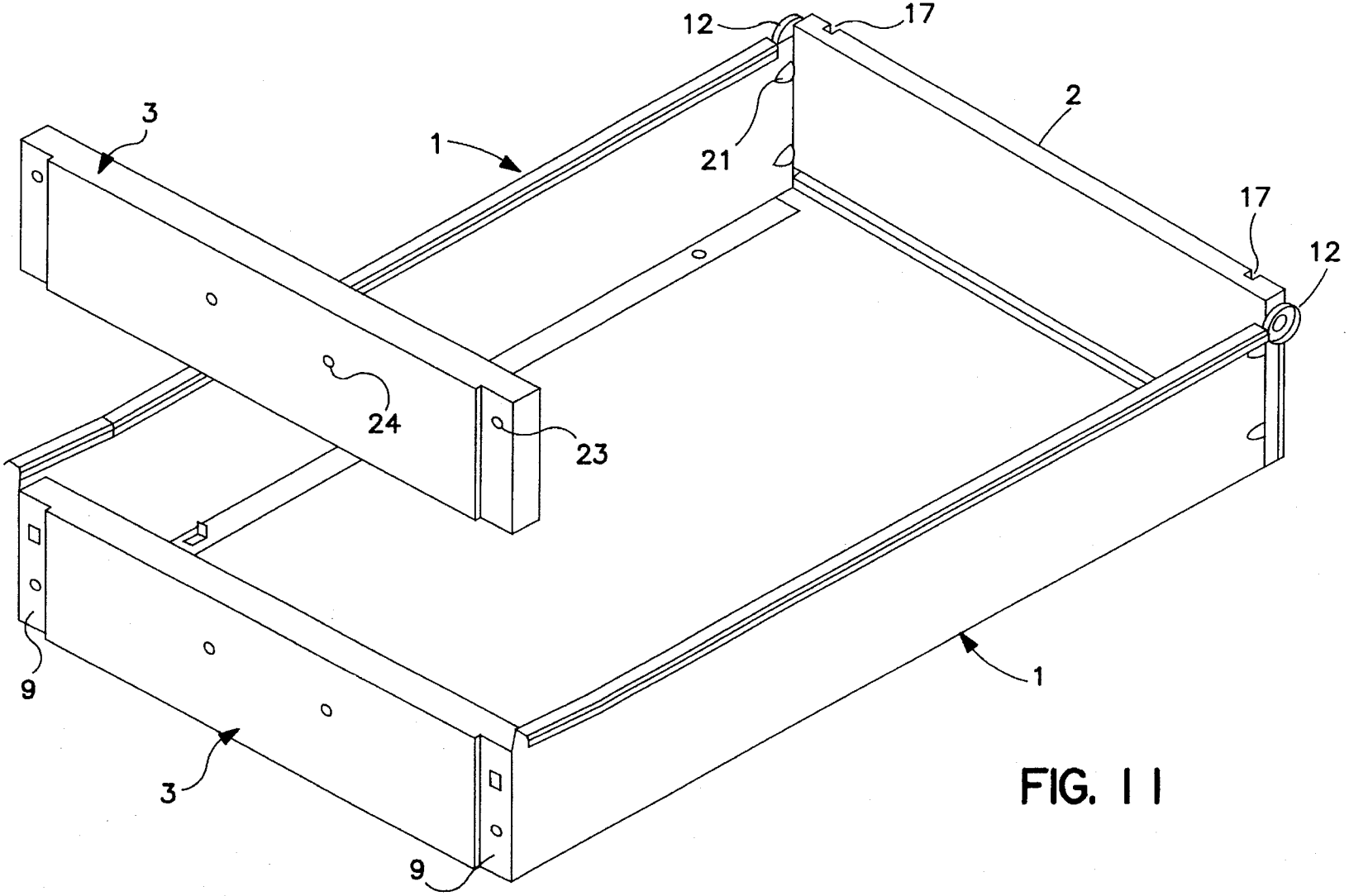
FIG. 11 is a perspective view of the drawer side walls, the rear wall and a front plate during assembly of the drawer.

A pair of drawer side walls I are provided at rear ends thereof with vertical flanges 4 to which a rear wall 2 is fastened. Front ends of the drawer side walls 1 are also provided with vertical flanges 9 to which a fastening plate 3 and a front plate 5 are connected. Both drawer side walls 1 are provided with horizontal support flanges 6 (FIG. 7) for a bottom plate 7. The support flanges 6 are provided with punched out flaps 8 which project into corresponding holes 28 in the bottom plate 7 (FIGS. 2, 4) and thereby prevent displacement of bottom plate 7.

Each side wall 1 is provided with an upper horizontal flange 10 which acts as a running flange for a corresponding roller 11 mounted on a support rail 13 that is to be fixed to the side wall of a cabinet. A roller 12 is mounted next to the flange 4 of each drawer side wall 1.

Each flange 4 is provided with stamped out U-shaped projections 14 each of which has a middle web 15 and inclined upper and lower webs 16. The U-shaped projections 14 project into respective vertical grooves 17 in the drawer rear wall 2, the rear wall 2 abutting the flanges 4. The rear wall 2 has adjacent a lower edge thereof a horizontal groove 18 into which projects a web 19 of the bottom plate 7.

Figure 12:
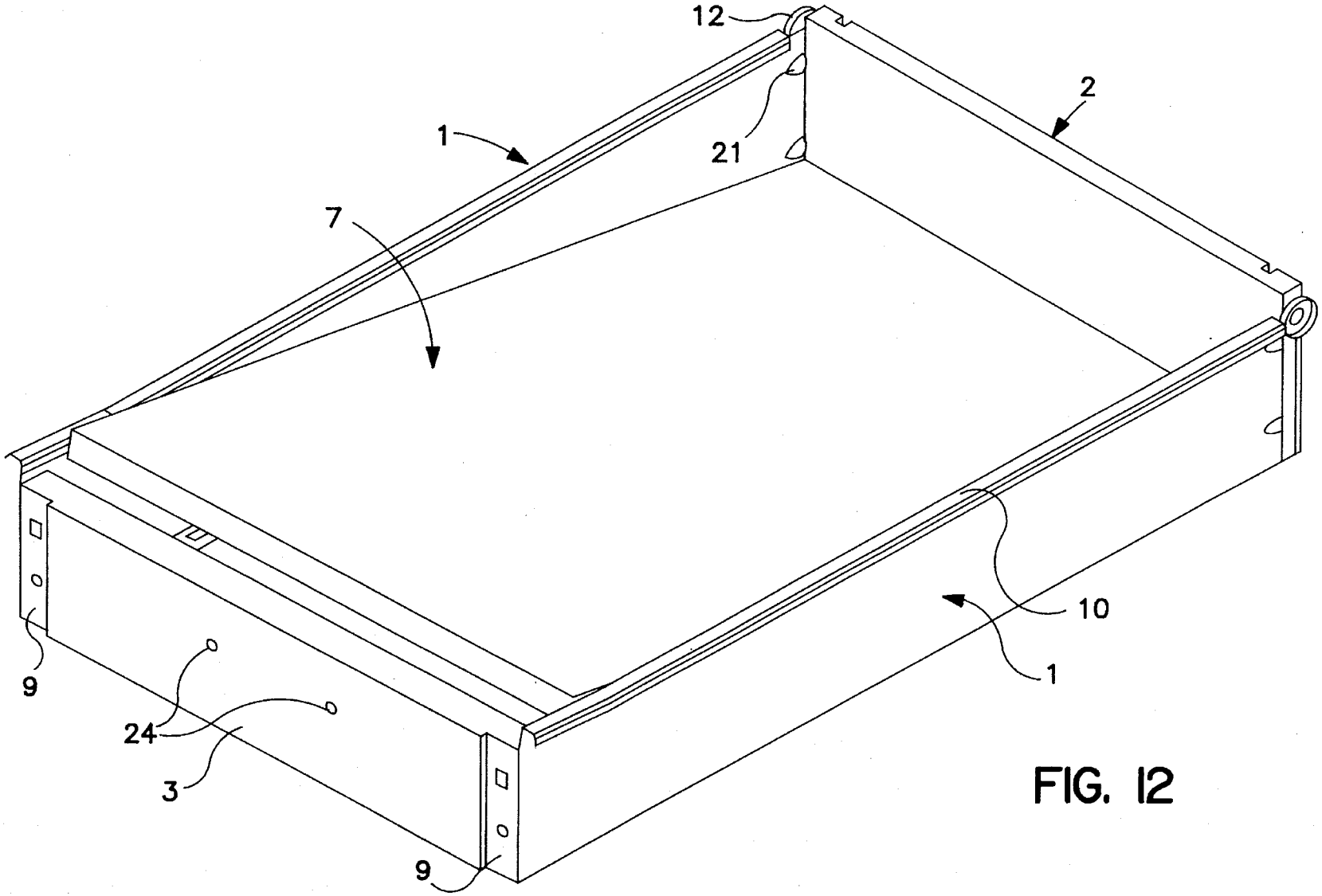
FIG. 12 is a perspective view of the drawer during insertion of a bottom plate.

In the embodiment of FIGS. 1 to 12, front end of the drawer side walls 1 are provided with the flanges 9, lower ends of which terminate with the respective support flanges 6 for the bottom plate 7. To make insertion of the bottom plate 7 possible, rear rims or edges 20 of the support flanges 6 are spaced from the flanges 4. During assembly of the drawer, the bottom plate 7 is inserted in an inclined orientation into a frame comprising the two drawer side walls 1, the rear wall 2 and the front plate 3, as shown in FIG. 12. The web 19 is inserted into the groove 18. Inner sides of drawer side walls 1 are provided with hobs or projections 21 which are spaced forwardly of flanges 4 and serve as a front support for the rear wall 2.

Figure 3:
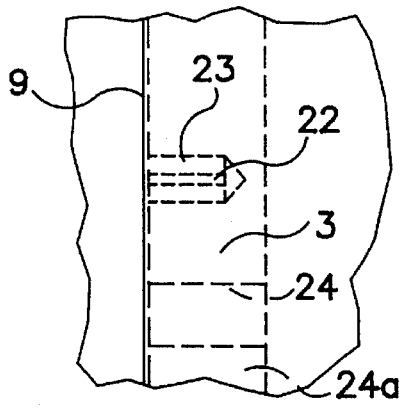
FIG. 3 is an enlarged view of detail A of FIG. 2.

The flanges 9 are provided with flaps 22 which are stamped out of the flanges 9. The flaps 22 project into holes 23 in the fastening plate 3 and provide anchorage for the fastening plate 3. When the drawer consisting of the two drawer side walls 1, the rear wall 2, the bottom plate 7 and the fastening plate 3 is assembled, a front plate 5 can be mounted by means of screws or dowels **24*a* projecting into holes 24 in the front plate 3 (FIG. 3). By such screws or dowels, the front plate 5 and the fastening plate 3 are secured to each other. As the flaps 22 are very thin, the position of the fastening plate 3 can be adjusted while the fastening plate 3 is mounted on the flaps 22**.

Figure 13:
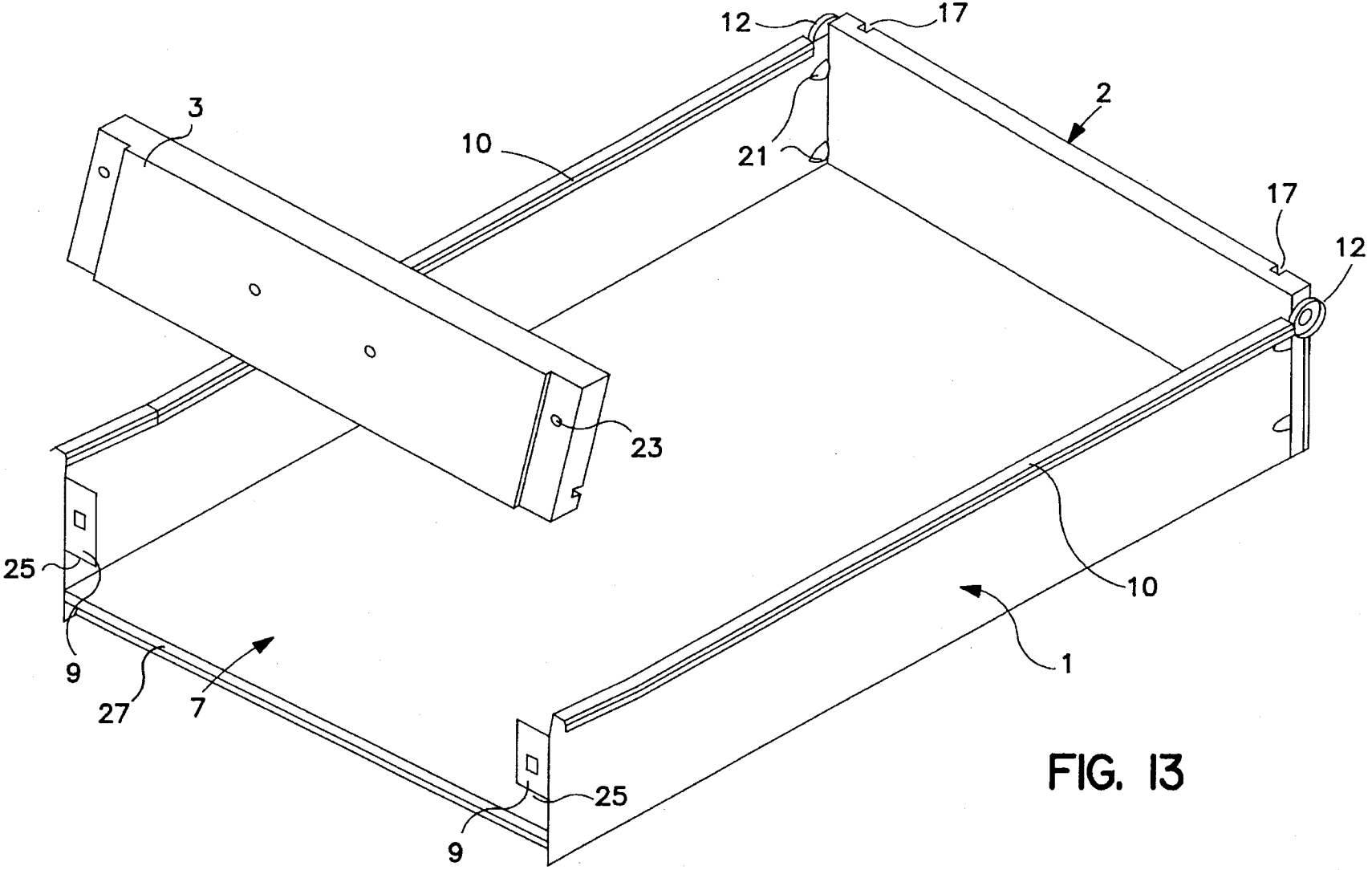
FIG. 13 is a perspective view of a further embodiment of the drawer.
Figure 14:
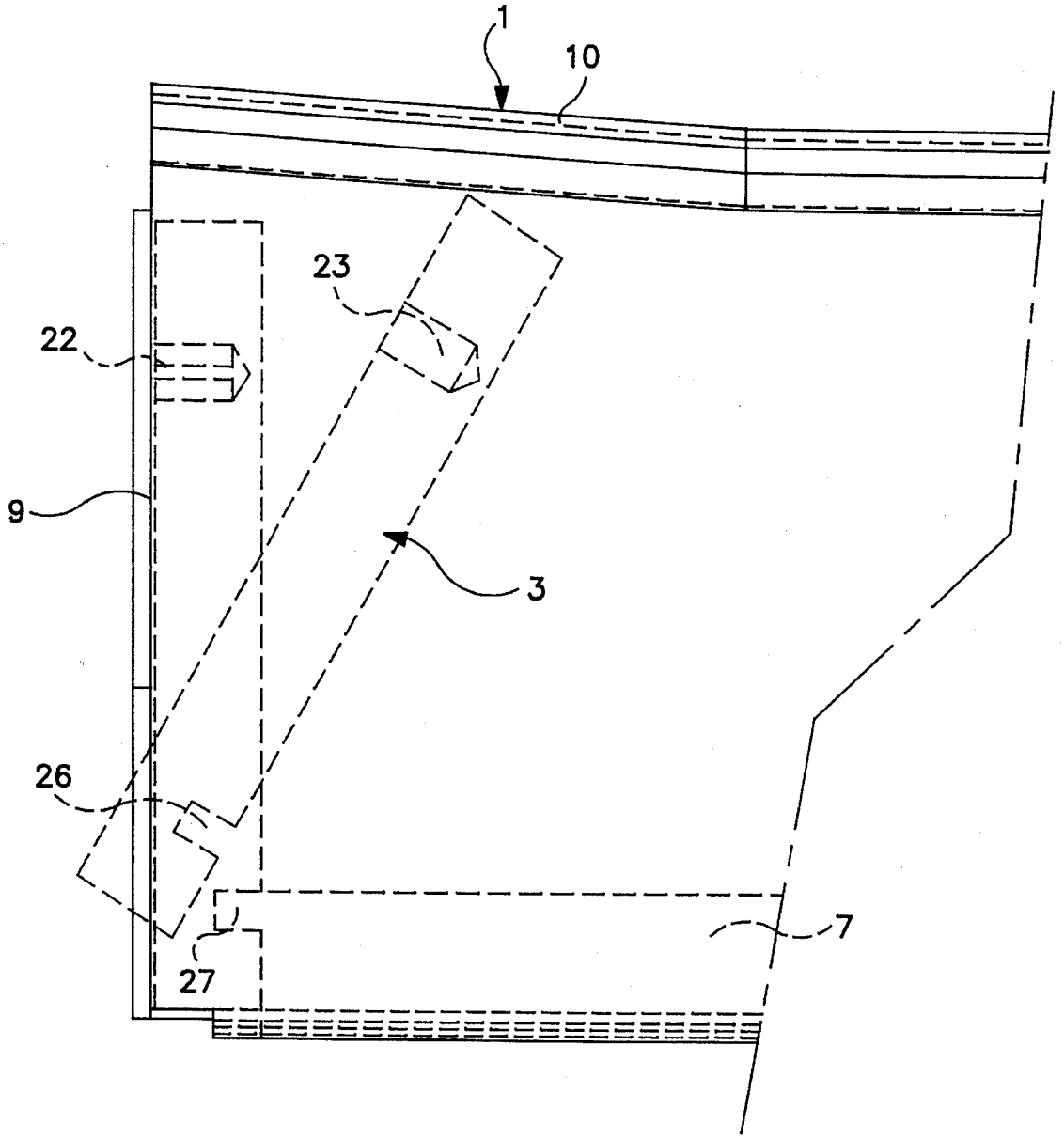
FIG. 14 is a side view of a front end of such drawer.

To make it possible that the fastening plate 3 can be inserted when the bottom plate 7 is already mounted in the drawer assembly, the embodiment of FIGS. 13 and 14 shows that the front flanges 9 of the drawer side walls 1 are shorter than the rear flanges 4. Lower rims or edges 25 of the front flanges 9 are spaced from the bottom plate 7. The fastening plate 3 is, like the rear wall 2, provided with a horizontal groove 26 into which a front web 27 of the bottom plates 7 projects. When the drawer is assembled the fastening plate 3 can, as shown in FIGS. 13 and 14, be inserted into the drawer while being tilted at approximately 30° with respect to its vertical position and then be pushed downwardly. When the horizontal groove 26 is next to the web 27 of the bottom plate 7 the fastening plate 3 is brought into a vertical position, whereby the flaps 22 are pushed into the holes 23 of the fastening plate 3. Thereafter, the front plate 5 is screwed to the fastening plate 3, whereby a rigid connection between the front plate 5, the fastening plate 3 and the drawer side walls 1 is obtained.

We claim:

1. A drawer assembly of unassembled components to be assembled to form a drawer, said assembly comprising:

a bottom plate;

a rear wall;

a fastening plate having opposite ends and a front surface having therein, adjacent said opposite ends, forwardly opening holes;

two metal side walls, each said side wall having a rear end to be attached to a respective end of said rear wall, a horizontal support flange to support a respective side of said bottom plate, and a front end having an inwardly extending vertical flange, each said vertical flange, having a rear side having a rearwardly extending lug to be received in a respective said forwardly open hole of said fastening plate when said fastening plate is positioned with said front surface thereof abutting said rear side of said vertical flange of each of said side walls; and a front plate to be connected to said front surface of said fastening plate with a rear surface of said front plate abutting a front side of said vertical flange of each of said side walls.

2. An assembly as claimed in claim 1, wherein said support flange has at least one upwardly extending lug to be received in a downwardly opening hole in said bottom plate.

3. An assembly as claimed in claim 1, wherein said lug of said vertical flange is punched from the material thereof.

4. An assembly as claimed in claim 1, wherein said rear end of said side wall has an inwardly extending vertical flange having at least one forwardly extending projection to engage said rear wall.

5. An assembly as claimed in claim 4, wherein said rear wall has on adjacent opposite ends thereof respective rearwardly facing vertical grooves to receive respective said projections of said rear end vertical flanges of said side walls.

6. An assembly as claimed in claim 5, wherein each said rear end vertical flange has plural projections to project into a respective said vertical groove.

7. An assembly as claimed in claim 5, wherein each said side wall has an inwardly extending knob located forwardly of the respective said rear end vertical flange and defining therewith a space to receive a respective said end of said rear wall with front and rear faces thereof to abut said knob and said rear end vertical flange, respectively.

8. An assembly as claimed in claim 5, wherein said rear wall is made of wood.

9. An assembly as claimed in claim 4, wherein said projection of said rear end vertical flange is stamped from the material thereof and is U-shaped.

10. An assembly as claimed in claim 9, wherein said U-shaped projection includes a middle vertical web and upper and lower webs inclined to the vertical.

11. An assembly as claimed in claim 4, wherein said support flange has a rear end spaced forwardly of said rear end vertical flange.

12. An assembly as claimed in claim 1, wherein said rear wall has in a front side thereof a horizontal groove into which is to fit a rearwardly extending web of said bottom plate.

13. An assembly as claimed in claim 1, wherein said vertical flange has a lower end terminating with said support flange.

14. An assembly as claimed in claim 1, wherein said vertical flange has a lower end located at a level higher than said support flange to define therebetween a space greater than the thickness of said bottom plate.

15. An assembly as claimed in claim 14, wherein said fastening plate has a rear surface having therein a horizontal groove to receive a web projecting forwardly from a front end of said bottom plate.

16. An assembled drawer comprising:

two metal side walls, each said side wall having a rear end, a horizontal support flange and a front end having an inwardly extending vertical flange having a rear side having a rearwardly extending lug;

a rear wall having opposite ends connected to rear ends of respective said side walls;

a bottom plate having opposite sides supported by support flanges of respective said side walls;

a fastening plate having opposite ends and a front surface having therein, adjacent said opposite ends, respective forwardly opening holes;

said fastening plate being assembled to said side walls with lugs of said vertical flanges being received in said holes in said fastening plate and with said front surface of said fastening plate abutting rear sides of said vertical flanges; and a front plate connected to said front surface of said fastening plate and having a rear surface abutting front sides of said vertical flanges.

17. An assembled drawer as claimed in claim 16, wherein said support flange has at least one upwardly extending lug received in a downwardly opening hole in said bottom plate.

18. An assembled drawer as claimed in claim 16, wherein said lug of said vertical flange is punched from the material thereof.

19. An assembled drawer as claimed in claim 16, wherein said rear end of said side wall has an inwardly extending vertical flange having at least one forwardly extending projection engaging said rear wall.

20. An assembled drawer as claimed in claim 19, wherein said rear wall has on adjacent opposite ends thereof respective rearwardly facing vertical grooves, and said projections of said rear end vertical flanges project into respective said vertical grooves.

21. An assembled drawer as claimed in claim 20, wherein each said rear end vertical flange has plural projections projecting into a respective said vertical groove.

22. An assembled drawer as claimed in claim 20, wherein each said side wall has an inwardly extending knob located forwardly of the respective said rear end vertical flange and defining therewith a space receiving a respective said end of said rear wall with front and rear faces thereof abutting said knob and said rear end vertical flange, respectively.

23. An assembled drawer as claimed in claim 20, wherein said rear wall is made of wood.

24. An assembled drawer as claimed in claim 19, wherein said projection of said rear end vertical flange is stamped from the material thereof and is U-shaped.

25. An assembled drawer as claimed in claim 24, wherein said U-shaped projection includes a middle vertical web and upper and lower webs inclined to the vertical.

26. An assembled drawer as claimed in claim 19, wherein said support flange has a rear end spaced forwardly of said rear end vertical flange.

27. An assembled drawer as claimed in claim 16, wherein said rear wall has in a front side thereof a horizontal groove into which fits a rearwardly extending web of said bottom plate.

28. An assembled drawer as claimed in claim 16, wherein said vertical flange has a lower end terminating with said support flange.

29. An assembled drawer as claimed in claim 16, wherein said vertical flange has a lower end located above said bottom plate.

30. An assembled drawer as claimed in claim 29, wherein said fastening plate has a rear surface having therein a horizontal groove receiving a web projecting forwardly from a front end of said bottom plate.

31. A metal drawer side wall to be assembled with other drawer components to form an assembled drawer, said metal drawer side wall comprising:

a rear end to be attached to a drawer rear wall, said rear end having an inwardly extending vertical flange having at least one forwardly extending projection;

a horizontal support flange to support a drawer bottom plate; and a front end to support a drawer fastening plate and a drawer front plate, said front end having an inwardly extending vertical flange, with a lug extending rearwardly from a rear side of said vertical flange.

32. A metal drawer side wall as claimed in claim 31, wherein said support flange has at least one lug extending upwardly therefrom.

33. A metal drawer side wall as claimed in claim 31, wherein said lug is punched from the material of said vertical flange.

34. A metal drawer side wall as claimed in claim 31, wherein said rear end vertical flange has plural said projections spaced vertically of each other.

35. A metal drawer side wall as claimed in claim 31, further comprising an inwardly extending knob located forwardly of said rear end vertical flange and defining therewith a space.

36. A metal drawer side wall as claimed in claim 31, wherein said projection is stamped from the material of said rear end vertical flange and is U-shaped.

37. A metal drawer side wall as claimed in claim 36, wherein said U-shaped projection includes a middle vertical leg and upper and lower webs inclined to the vertical.

38. A metal drawer side wall as claimed in claim 31, wherein said support flange has a rear end spaced forwardly of said rear end vertical flange.

39. A metal drawer side wall as claimed in claim 31, wherein said front end vertical flange has a lower end terminating with said support flange.

40. A metal drawer side wall as claimed in claim 31, wherein said front end vertical flange has a lower end located at a level higher than said support flange.

* * * * *